US006746176B2

(12) United States Patent
Smith

(10) Patent No.: US 6,746,176 B2
(45) Date of Patent: Jun. 8, 2004

(54) TRANSPORTABLE RIG MAT MODULE AND ASSEMBLY

(76) Inventor: Ronald Edwin Smith, P.O. Box 3103, Palmer, AK (US) 99645

( * ) Notice: Subject to any disclaimer, the term of this patent is extended or adjusted under 35 U.S.C. 154(b) by 0 days.

(21) Appl. No.: 10/052,046

(22) Filed: Jan. 17, 2002

(65) Prior Publication Data

US 2003/0133751 A1 Jul. 17, 2003

(51) Int. Cl.[7] ..... E01C 5/16
(52) U.S. Cl. ..... 404/35
(58) Field of Search ..... 404/19, 34, 35, 404/36; 238/14; 14/69.5

(56) References Cited

U.S. PATENT DOCUMENTS

| | | | | | |
|---|---|---|---|---|---|
| 2,082,563 | A | * | 6/1937 | Bauer | 473/278 |
| 2,308,943 | A | * | 1/1943 | Tietig et al. | 52/781 |
| 3,517,791 | A | * | 6/1970 | Miles | 193/41 |
| 4,289,420 | A | | 9/1981 | Davis et al. | |
| 4,376,596 | A | | 3/1983 | Green | |
| 4,522,009 | A | | 6/1985 | Fingerson | |
| 4,600,337 | A | | 7/1986 | Sarver | |
| 5,273,373 | A | | 12/1993 | Pouyer | |
| 5,325,558 | A | * | 7/1994 | Labreche | 14/69.5 |
| 5,538,183 | A | * | 7/1996 | McGee | 238/14 |
| 5,653,551 | A | | 8/1997 | Seaux | |
| 5,740,575 | A | * | 4/1998 | Gordon | 14/69.5 |
| 5,938,397 | A | * | 8/1999 | Schouest | 414/537 |
| 6,009,587 | A | * | 1/2000 | Beeman | 14/69.5 |
| 6,139,249 | A | * | 10/2000 | Lucht | 414/537 |
| 6,185,775 | B1 | * | 2/2001 | McCarthy | 14/69.5 |
| 6,389,629 | B1 | * | 5/2002 | Schouest | 14/69.5 |

* cited by examiner

*Primary Examiner*—Gary S. Hartmann
(74) *Attorney, Agent, or Firm*—Sherman D. Pennia

(57) ABSTRACT

The rig mat is laid on a substrate to provide a surface to bear and distribute weight over the substrate. The rig mat call be used individually or juxtaposed in an assembly of mats to provide the bearing surface. The rig mat has a top plate and a bottom plate disposed in parallel alignment. A spacer grate is sandwiched between and fixed to the plates. An edge binder is disposed around the perimeter edges of the plates to bind them together and to enclose the spacer grate within the space between the plates. The spacer grate is made up of a number of grating bars disposed in a parallel to each other. Cross-rods disposed in parallel to each other and perpendicular to the grating bars pass through and attach to the grating bars to fix the spacing between the grating bars.

1 Claim, 7 Drawing Sheets

Fig. 3A, (Section C)

Section A, Fig. 7

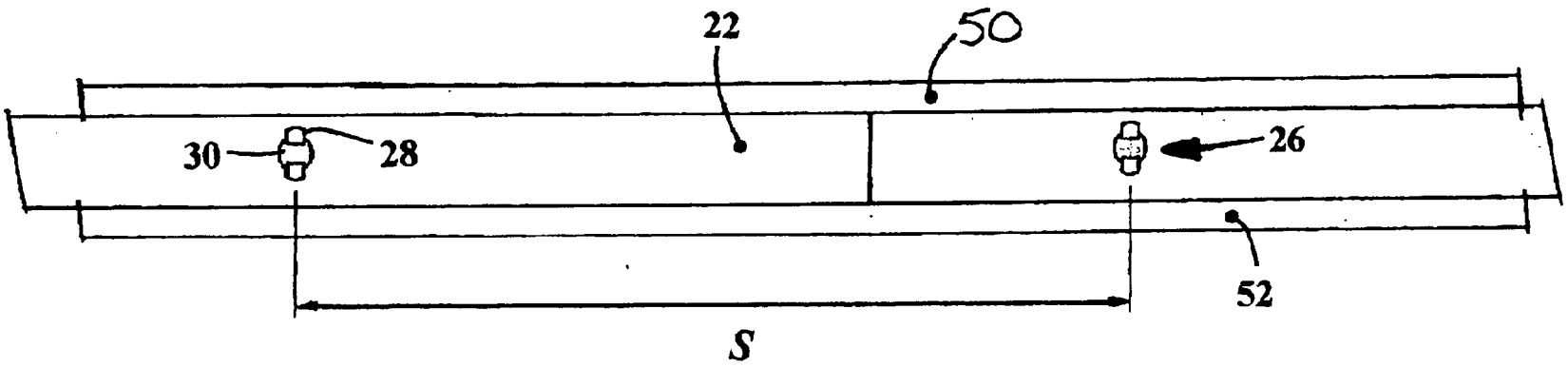
*Section B, Fig. 8*

TRANSPORTABLE RIG MAT MODULE AND ASSEMBLY

FIELD OF THE INVENTION

The present invention is in the field of surface mats for supporting a mass and distributing its weight over a surface under the mat. More specifically, the present invention relates to performed, portable mat structures for covering a relatively large area, and designed for easy transport and rapid and repeated installation, and may be juxtaposed on a surface to provide a work apron and/or travel way.

BACKGROUND OF THE INVENTION

The field long has been motivated to provide mass supporting and weight distributing temporary surfaces over suitable substrates on which heavy equipment or vehicles can be placed and operated. In the past, such temporary surfaces over unstable substrates (e.g., soft earth) were constructed of wooden planks. However, these plank structures were found to be labor intensive, time consuming to construct and expensive. Therefore, alternatives to wooden plank structures were developed. Early alternatives to plank structures included wooden mat modules that individually could be assembled into larger surface covering structures (e.g., see Davis et al, U.S. Pat. No. 4,289,420). The field recognized advantages of modular wooden mat structures and alternative wooden mat modules were developed. See Green, U.S. Pat. No. 4,376,596; Sarver; U.S. Pat. No. 4,600,337; and Pouyer, U.S. Pat. No. 5,273,373.

However wood mats had some inherent disadvantages, and recognition of these motivated tie field to develop mat modules constructed of composites and other materials as an alternative to wood. For example, Seaux, U.S. Pat. No. 5,653,551, discloses a composite mat module having partially overlapping upper and lower layers. The Seaux mats interlock with each other at their perimeter edges, where the two layers of the module do not overlap. However, this configuration means that a surface constricted of the Seaux mats will only be half as thick at its peripheral edge than it is everywhere else.

Therefore, it would be beneficial to have an alternative performed, composite mat module that can be used either individually or in an assembly and have the same mass supporting and weight distributing properties over substantially all of its surface.

SUMMARY OF THE INVENTION

The present invention is a rig mat module for bearing and distributing weight on a surface. More specifically, one or more of the present rig mat modules is to be laid on a substrate surface that otherwise cannot bear or is to be protected from the weight of an object placed on or moved across the top surface of the rig mat module. The present rig mat module may be placed singly or juxtaposed in groups to provide a weight bearing and distributing surface such as a work apron or travel/road way. A surface assembly of juxtaposed rig mat modules can be attached together at their perimeter edges to improve the stability of the surface assembly. Such surfaces can be used as crane pads, for creating a gravel-less, field work site, and for protecting relatively soft surfaces from the effects of heavy equipment use.

The present rig mat module comprises a spacer grate sandwiched between a top plate and a bottom plate. Each plate has an exposed or exterior surface, an interior surface and a perimeter edge. The plates are disposed in parallel alignment with the interior surfaces of the plates juxtaposed to define a grating space between them. The spacer grate is disposed within the grating space between the top and bottom plates and is in contact with and fixed to the interior surfaces of the top and bottom plates. An edge binder is disposed around the assemblage of the plates and spacer grate to engage the perimeter edges of the plates. The binder encloses the grating space and provides additional structural integrity to the perimeter of the assemblage.

The top and bottom plates are comprised of any suitable non-metal material as is selectable by one of ordinary skill in art in view of the teachings herein. Wood plates (e.g., plywood) or plates constructed of solid laminate plastics, fiberglass or other synthetic of composite materials may be used. Light metals, such as a metal mesh, may be embedded or molded into a plate for structural purposes or to provide gripping exterior surface to the plate. The thickness of the plates is selectable The ordinary skilled artisan depending on the anticipated loading of the rig mat module and the material construction of the plates. Also, the thickness and material of the two plates may be different each from the other. Further, the outer or exposed surfaces of the top and bottom plates may be different. For example, the exposed surface of the top plate may be a traction surface (e.g., for foot or vehicular traffic) while the exposed surface of the bottom plate is stippled to help anchor or improve its engagement with the surface on which it rests.

The spacer grate comprises a plurality of grating bars disposed relative to each other in a parallel and spaced relationship. The spaced relationship may be uniform for all grating bars or it may be varied to accommodate the expected mass load on different sections of the rig mat module. Each grating bar has a length, a width and a height. The width and the height define the cross-sectional of the grating bar, and the length defines the dimension of fire grating bars that are in parallel with each other. Typically the cross-section of the grating bar is substantially oblong. The spaced relationship of the grating bars (how far one grating bar is from an adjacent grating bar) is about 2-times to 20-times the width of the grating bar. The width of the grating bar is about 0.5 to about 1.0 inches. For large mass loads, a preferred spaced relationship is 2 with the width of the grating bar being about 0.6 inches. As with the spaced relationship of the grating bars, the width slay be uniform for all grating bars or it may be varied to accommodate the mass expected mass on different sections of the rig mat module. The height of the grating bar is about 1.0 to about 2.0 inches, and preferably about 1.5 inches. The grating bars themselves may be constricted using a pultrusion process, as is known in the art (e.g., see U.S. Pat. No. 4,522,009 to Fingerson). The grating bars also each have a plurality of rod apertures passing through the surfaces of the grating bar perpendicular to its width. The rod apertures have a thickness and are disposed in alignment with adjacent grating bars. The rod apertures are for closely passing dowel-rods therethrough. The length of the grating bars is dependent on the intended use of the rig mat module and the size of the area to be covered. It is intended in the present invention that the length of the grating bars be at least about two feet.

The spacer grate also comprises a plurality of dowel-rods disposed in a parallel spaced relationship to each other and in perpendicular relationship to the grating bars. The dowel-rods pass through the rod apertures and attach to the grating bars to fix the spaced relationship of the grating bars. A dowel-rod comprises two spacer-rods separated by a wedge-rod. A spacer-rod has an outer engagement surface and an inner flat surface. The outer engagement surface of the spacer rod has spaced engaging means for engaging the grate bar where the dowel-rod passes through the rod-aperture. The inner flat surface of the spacer rod slidably interfaces with the wedge-rod. Typically, the outer engagement surface of the spacer rod has a plurality of notches, for closely engaging the thickness of the rod-aperture as the dowel-rod passes through the grate bar. The notches are spaced apart to fix the spaced relationship of the grating bars. The wedge-rod has two similar opposite interface surfaces for slidably contacting the two spacer-rods and to hold the spacer-rods apart. Also, the wedge rod has two similar and opposite curvilinear surfaces, disposed to closely pass through the rod-apertures. The wedge-rod is adhered at the interface surface of each of the two spacer-rods.

The rig mat module of the present invention optionally comprises a coupling means for holding the perimeter edge of the rig mat module adjacent to the perimeter edge of an adjacent rig mat module. An example of a coupling means is a simple stake passing through the rig mat module proximate its perimeter in a number of location to fix adjacent rig mat modules to the underlying surface. Alternatively, the stake can have a squared "U" configuration and be disposed to pass through two adjacent rig mat modules at the same time. If heavy anchoring of the mat modules is required, the mat modules may further comprise anchor bores distributed over the plane of the mat module, through which heavy duty stakes may be driven to anchor the mat in place on a ground surface.

The overall dimensions of a rig mat module is selectable by the ordinary skilled artisan and defined by the dimensions of the component parts and the total number of grating bars used. Roughly, the width of a rig mat module is the length of the grating bars used, and the run or length of the rig mat module is the number of grating bars times the spaced relationship. Where the desired overall dimensions of a rig mat module is larger than the dimensions of the individual components (plates, gratings bars or cross-bars), a plurality of the individual components can be used (e.g., two grating bars in series) to accomplish the desire overall dimensions. If the dimensions of a module require that it be comprised of multiple plates on each side of the module, and the plates are asymmetric (i.e., have a grain line) the plates on opposite sides of the module may be disposed to have the asymmetry be perpendicular and off-setting The top and bottom plate elements of the rig mat module allow a point or focused weight to be placed on the mat and distributed over multiple grating bars, which otherwise could not be placed on an open grating. Additionally, the plate covered rig mat modules of the present invention have broader utility than open grate mats on soft surfaces such as marshy or muddy soil. The thickness of the plates can be different depending on the anticipated loading of the top plate and the surface contacting the bottom plate. The plates can be a single thickness or comprised of a laminate. Additionally, either exterior surface of a plate can be layered with a cover plate which is removable. The cover plate can be utilized to provide protection to the plate under it or to increase it loading capacity. A cover plate can be replaced when worm or not needed, or can be switched out to provide a surface on the rig mat module suitable for a specific purpose (e.g., a high friction or gripping surface in a wet environment).

BRIEF DESCRIPTION OF THE DRAWINGS

FIGS. 3A to 3C are end views of an edge section of the present rig mat module showing the top and bottom plates sandwiching a length of grating bar and an end view of cross-rods engaged in the rod apertures of the grating bar. The views 3A to 3C show different means of attaching an edge binder to the perimeter edge of a mat module.

FIG. 7 is a side view of the spacer grating viewed end-on to the grating bars (section A of FIG. 6), aid illustrates a cross-rod halving a spacer-rod made up of two shorter length pieces and end-butted together to provide an overall longer spacer-rod.

FIG. 8 is a side view of the spacer grating showing a length of a grating bar (section B of FIG. 6), and illustrates a grating bar up of two shorter length pieces and end-butted together to provide the overall longer grating bar.

DETAILED DESCRIPTION OF THE INVENTION

Figure 1:
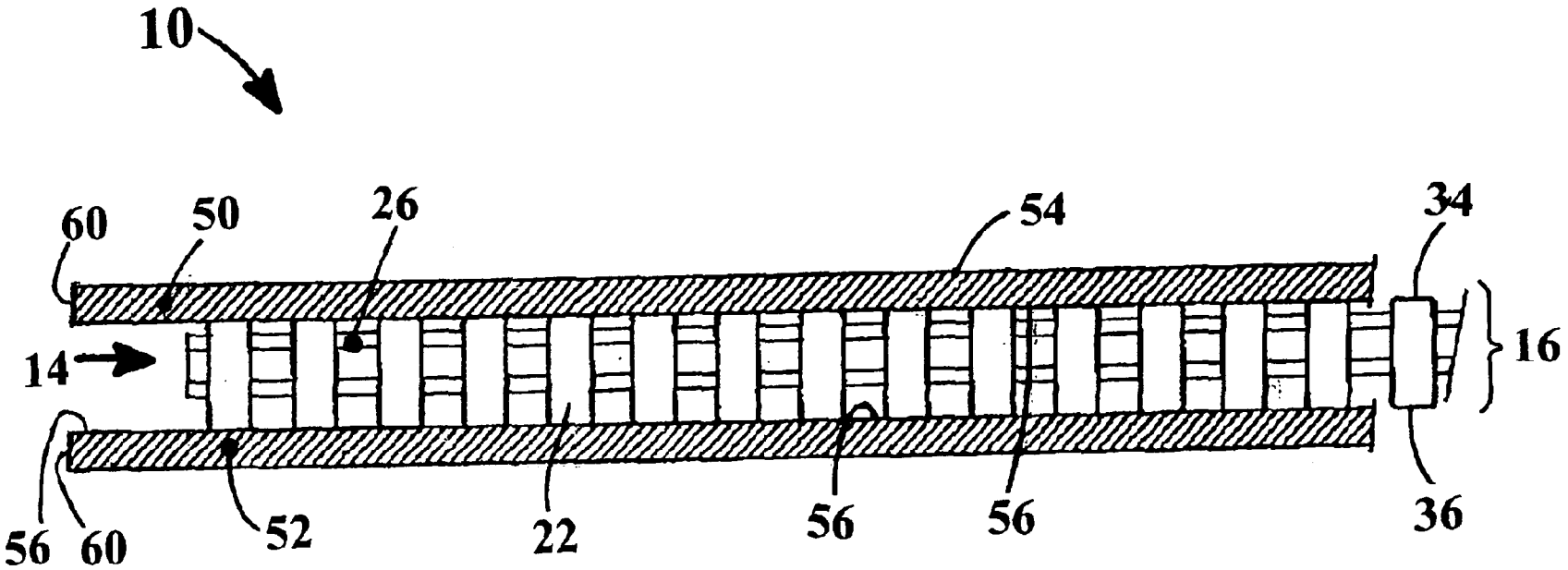
FIG. 1 is a side view of the rig mat module showing the spacer grate received in the grating space between the top and bottom plates with the grating bars seen in cross-section.

The rig mat of the present invention is substantially planar device for supporting a mass and distributing its weight over the surface on which it is lain. The present rig mat modules, singly or combined in an assembly, are useful for constructing temporary roadways, crane and equipment pads and foundations for other temporary structures (e.g., scaffolding and platforms).

Referring now to the drawings, the details of preferred embodiments of the present invention are graphically and schematically illustrated. Like elements in the drawings are represented by like numbers, and any similar elements are represented by like numbers with a different lower case letter suffix.

As shown in FIG. 1, the rig mat 10 of the present invention comprises a top plate 50 and a bottom plate 52, each plate having an exposed surface 54, an interior surface 56 and a perimeter edge 60. The plates 50, 52 are disposed in parallel alignment with their interior surfaces 56 juxtaposed to define a grating space 14 between them. The spacer grate assembly 16 is disposed within the grating space 14. The spacer grate 16 is in contact with and is fixed to the interior surfaces 56 of the top and bottom plates 50 & 52 at the upper and lower bearing surfaces 34, 36 of the spacer grate assembly 16 grating bars 22. In the preferred embodiment, the interior surfaces 56 of the top and bottom plates 50 & 52 are fixed to the upper and lower bearing surfaces 34, 36 of the grating bars 22 using an adhesive 68 (see FIGS. 3*a* to 3C).

The spacer grate 16 comprises a plurality of grating bars 22 disposed in a parallel spaced relationship to each other, and a plurality of cross-rod assemblies 26 disposed in a parallel spaced relationship to each other and in perpendicular relationship to the grating bars 22. The cross-rod assemblies 26 pass through and are attached to the grating bars 22 to fix the spaced relationship of the grating bars 22 relative to each other.

Figure 2:
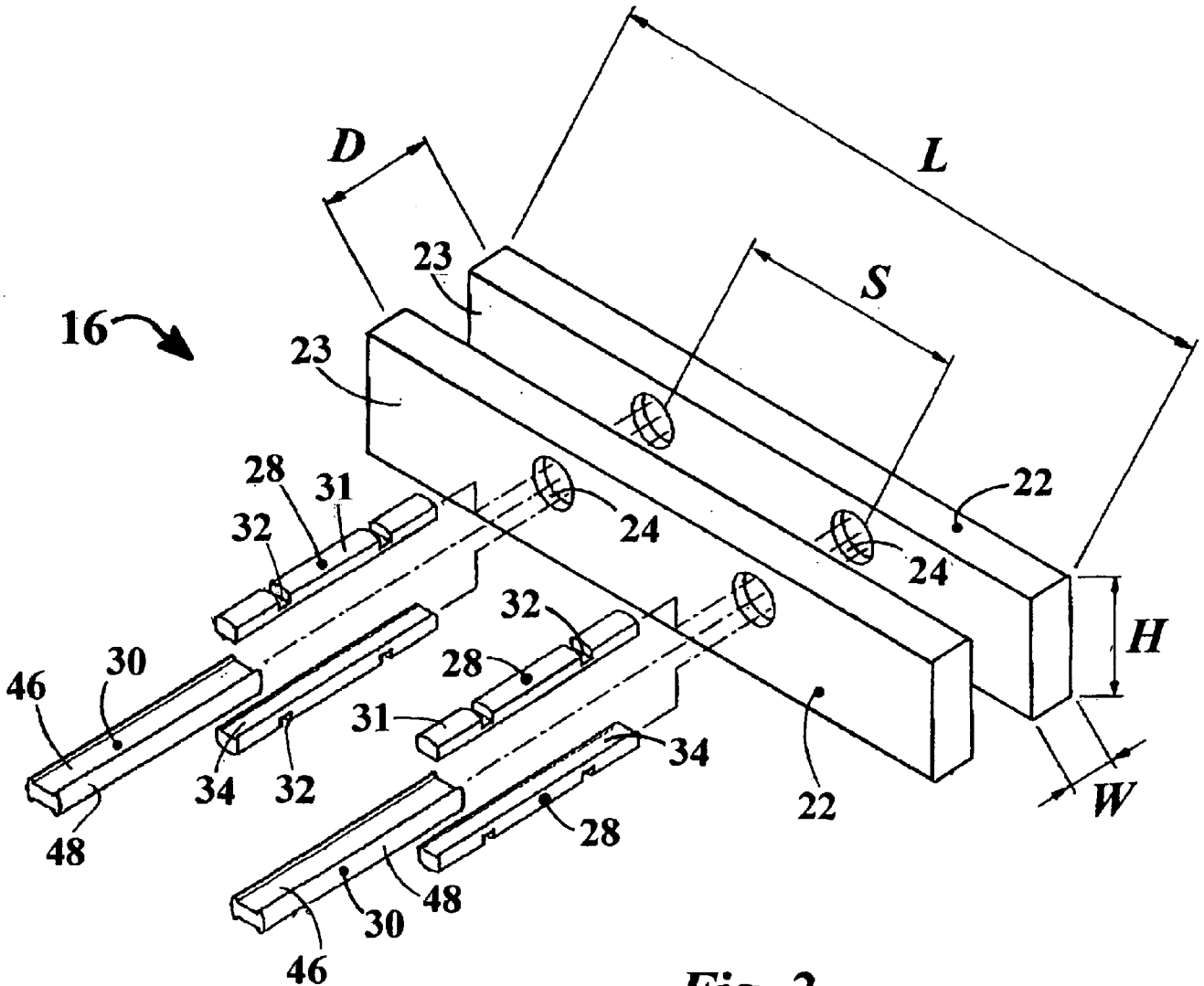
FIG. 2 is a exploded perspective view showing the relationship of the grating bars to the components of the dowel-rods.

As shown in FIG. 2, each grating bar 22 has a length L, a width W and a height H. The width and the height H define the cross-section of the grating bar 22. Preferably, the grating bars 22 have a cross-section that is substantially oblong. The length L of the grating bars 22 range from at least about 2 feet and longer. The length L of the grating bars 22 defines the dimension of the grating bars 22 that are in parallel with each other. The spaced relationship D of the grating bars 22 is about 2-times to 20-times the width W of the grating bars 22. The width W of the grating bars 22 is about 0.5 to about 1.0 inches. For large mass loads, in a preferred embodiment spaced relationship D was 2-times the width W with the width W of the grating bar 22 being about 0.6 inches. The height H of the grating bars can be about 1.0 to about 2.0 inches, and in the preferred embodiment was about 1.5 inches.

The grating bars 22 further comprise a plurality of rod apertures 24 passing through a height surface 23 of the grating bar 22, which is perpendicular to the width W of the grating bar 22. The rod apertures 24 are disposed in alignment for closely passing therethrough the cross-rods assemblies 26. The distance S between adjacent rod apertures 24 in a preferred embodiment was about 18 inches. However, the spacing S between rod apertures is selectable by the ordinary skilled artisan in view of the expected mass and dynamics (movement) of the load on the top plate 50 of the rig mat 10.

A cross-rod assembly 26 comprises two spacer-rods 28 separated by a wedge-rod 30. See FIG. 2. Each spacer-rod 28 has an outer engagement surface 31 and an inner flat surface 34. The spacer-rods 28 are shaped with a curvilinear outer engagement surface 31 to facilitate passing a relatively larger cross-section of spacer rod 28 through the cross-rod apertures 24 than without the curvilinear engagement surface 31. The outer engagement surface 31 has a plurality of spaced engaging means 32 for engaging the grating bar 22 where the cross-rod 26 passes through the rod-aperture 24. The inner flat surface 34 serves as a mating surface that slideably interfaces with the wedge-rod 30. In a preferred embodiment, the outer engagement surface 31 of the spacer rod 28 includes a plurality of engagement means 32. In the embodiment shown, the engagement means 32 were notches for closely engaging the thickness of the rod-apertures 24 as the cross-rod assemblies 26 passed through the grating bars 22. The notches 32 were spaced apart and fixed the spaced relationship D of the grating bars 22.

The wedge-rod 30 has two similar and opposite interface surfaces 46 for slidably contacting the mating surface 34 of each of the two spacer-rods 28, and for separating the spacer-rods 28 apart. Additionally, off-set 90 degrees from the interface surfaces 46, the wedge-rod 30 has two other similar and opposite curvilinear surfaces 48, the curvilinear surfaces 48 disposed to closely pass through the rod-apertures 24. The cross bar wedge-rods 30 are preferably I-shaped, with their interface surfaces 46 indented or recessed to facilitate slidably receiving the spacer-rods 28.

Figure 3C:
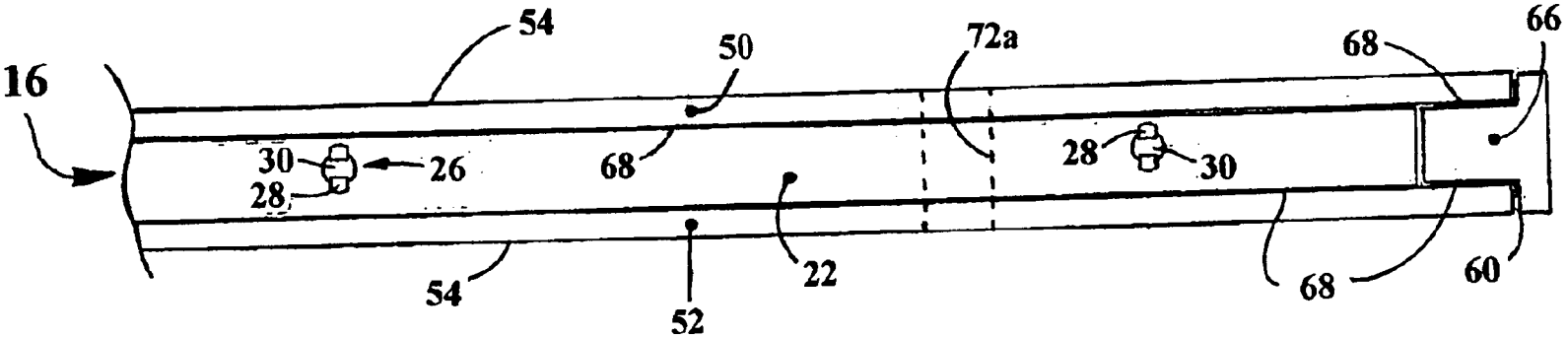
Figure 3C:
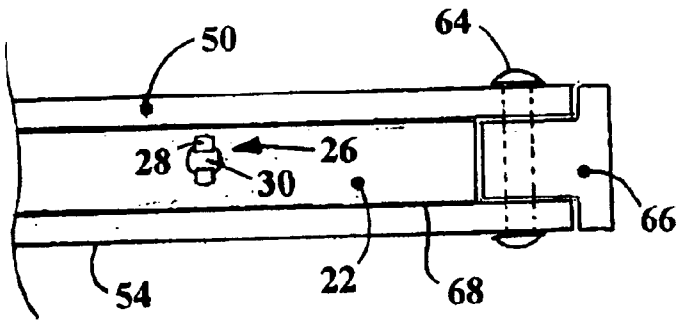
Figure 3B:
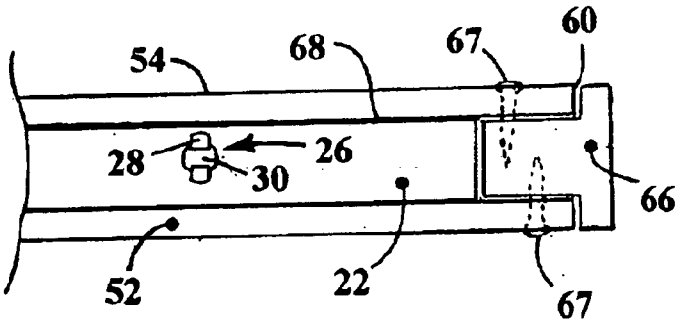

As shown in FIGS. 3A to 3C, an edge binder 66 is disposed around the perimeter of the assembled plates 50 & 52 and spacer grate 16 to engage the perimeter edges 60 of the plates 50 & 52. The binder 66 encloses the grating space 14 (see FIG. 1) and provides additional structural integrity to the perimeter of the assembled rig mat module 10. The binder 66 may have a cross section configured in a "T"-shape as shown in FIGS. 3A to 3C, or may be flush with the perimeter edge (not shown), or some other configuration (e.g., see FIGS. 4A and 4B). The edge binder 66 can be fixed in place or can be removable by a choice of means known to one of ordinary skill in the art, such as a fastener 64 like a rivet or bolt and nut, a screw 67 or an adhesive 68.

Figure 4A:
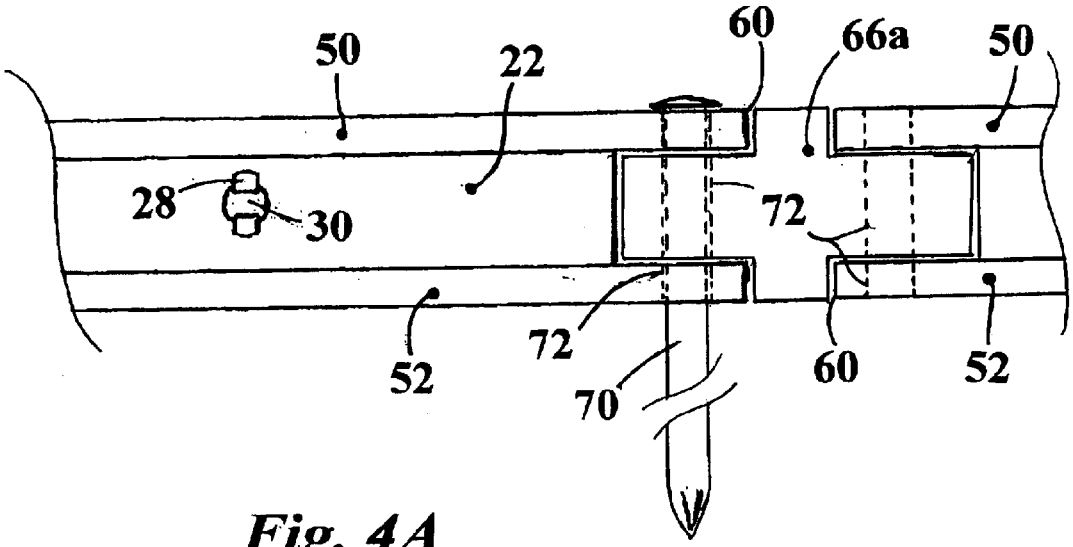
FIGS. 4A & 4B are side edge views of an edge section of the rig mat module showing variations on the edge binding useful for joining two separate mat modules together at an adjoining perimeter edge.
Figure 4B:
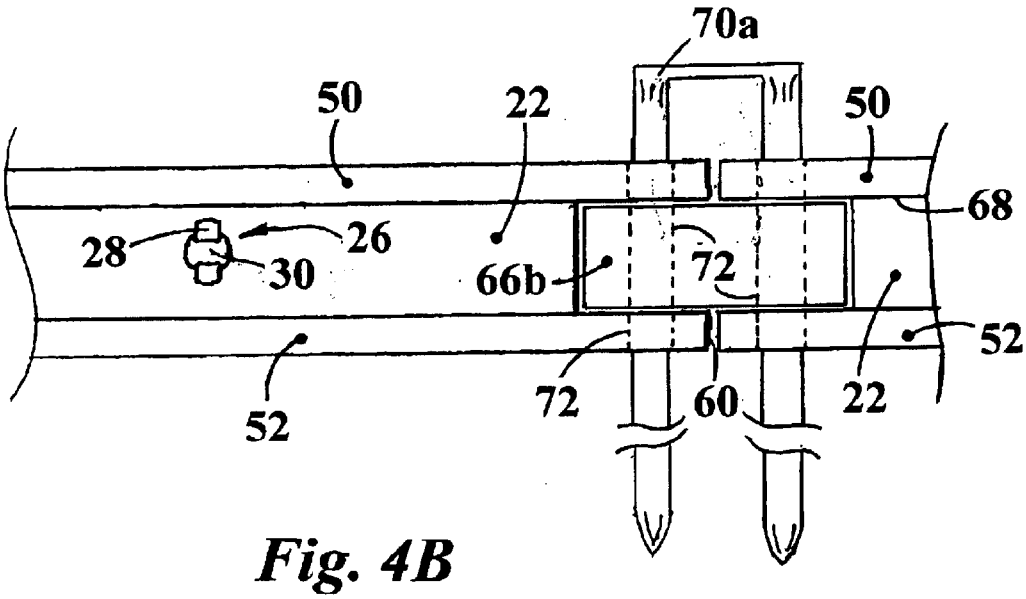

To form a rig mat assembly, a plurality of rig mat modules are lain on a ground surface adjacent each other in a desired pattern and anchored to the ground surface using stakes. Alternatively, to facilitate anchoring the mat modules 10 relative to each other on a ground surface, as shown in FIGS. 4A and 4B, the rig mat module 10 of the present invention optionally comprises a coupling means for holding the perimeter edge of the rig mat module adjacent to the perimeter edge of an other rig mat module 10. An example of a coupling means is a simple stake 70 passing through an anchor bore 72 in the plates 50 & 52 and edge binder 66 of the rig mat module 10 proximate its perimeter edge 60 in a number of location to fix adjacent rig mat modules 10 to an underlying surface. The edge binder 60 used in the coupling means can take a variety of cross sectional configurations as shown in the figures. It can be a "+"-shaped binder 66*a* or a plane block binder 66*b*. In a preferred embodiment, when the binder edge 66*a* & 66*b* is utilized as a part of a coupling means, it is removable from the both of the adjacent mat modules 10, as shown in FIGS. 4A and 4B. The stake 70*a* can have a squared "U" configuration and be disposed to pass through two adjacent rig mat 10 at the same time. If heavy anchoring of the mat modules 10 is required, the mat modules 10 may further comprise anchor bores 72*a* (see FIG. 3.) distributed over the plane of the mat module, through which heavy duty stakes (not shown) may be driven to anchor the mat module 10 in place on the ground surface.

Figure 5B:
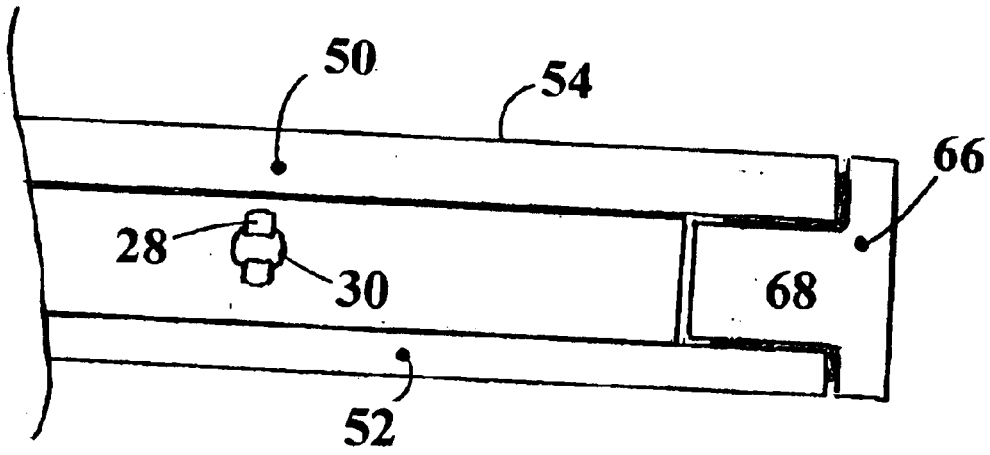
FIGS. 5A & 5B are side edge views of a section of a rig mat module showing alternative embodiments of the top and bottom plates, where the plates are different thicknesses (A) or where a plate is covered with a laminate or cover plate (B).
Figure 5A:
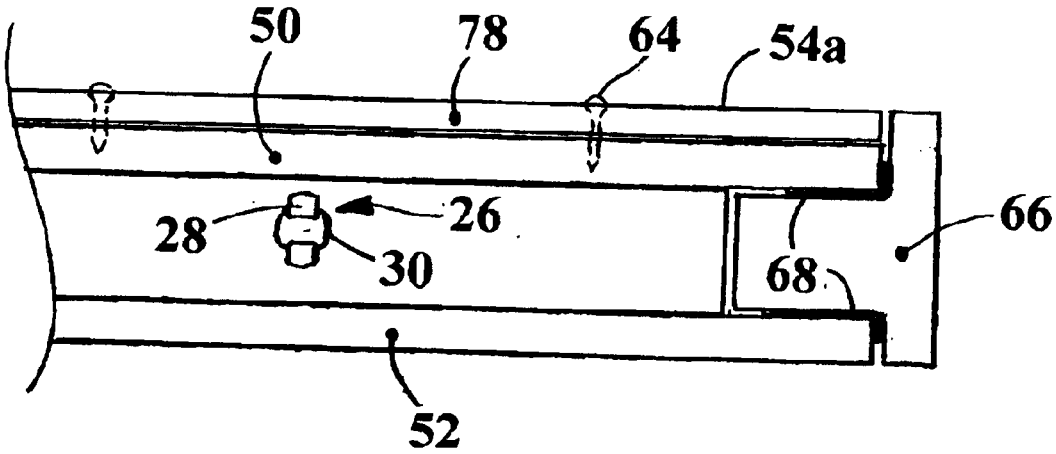

As shown in FIG. 5A, the thickness of the plates 50 & 52 can be different depending on the anticipated loading of the top plate 50 and/or the condition of the surface contacting the bottom plate 52. The plates 50 & 52 themselves can be a single thickness or comprised of a laminate. Additionally, as shown in FIG. 5B, either exterior surface 54 of a plate 50 & 52 can be layered with a cover plate 78 which is removable. The cover plate 78 can be utilized to provide protection to the plate 50 & 52 under it or to increase its loading capacity. A cover plate 78 can be replaced when worn or not needed, or can be switched out to provide an exposed surface 54*a* on the rig mat module 10 suitable for a specific purpose (e.g., a high friction or gripping surface for a slippery environment). The cover plate can be removably attached to the exposed or exterior surface of a top or bottom plate 50 & 52 by any of a variety of means known to the ordinary skilled artisan, such as the use of screw fasteners 64 as shown in FIG. 5B.

Assembly of the present rig mat 10 from its component parts is readily accomplishable by one of ordinary skill in the art in view of the teachings and figures herein. Although alternative methods are known to the ordinary skilled artisan, one method of assembling the present rig mat 10 is to first assemble the spacer grating 16. A technique useful for assembling the spacer grating 16 of the rig mat module 10 is known in the art (see U.S. Pat. No. 4,522,009). Generally, the grating bars 22 are set out in the desired parallel and spaced relationship with their rod-apertures 24 in alignment. A pair of spacer rods 28 of an appropriate length, oriented with their engagement surfaces 31 in opposition, are inserted through the aligned rod-apertures 24. A wedge-rod 30 is slid between the two spacer-rods to separate them and cause the notches 32 to engage the thickness (or width W) of the rating bars 22.

In a preferred embodiment, all of the points of contact between the various structural components and features of the rig mat module 10 are bonded together, except for the cover plate 78, if one is utilized. In particular, this is practiced to bond the wedge-rod 30 to the two spacer-rods 28 at the two interface surfaces 46 of the wedge-rod 30. This may be accomplished using an adhesive, epoxy resin or like bonding agent that is appropriate for the constriction materials of the surfaces to be bound. Such bonding agents are known to and selectable by the ordinary skilled artisan for practice in the present invention. Of course, attachment means other than bonding agents, such as bolt, nail or screw type fasteners 64, may be utilized where appropriate, e.g., for attaching the binder edge 66 (see FIGS. 3A to 4B) or a cover plate 78 (see FIG. 5B).

Preferably, component parts of the present invention 10 are fiber reinforced plastic (FRP) shapes constructed using a pultrusion process as is known in fire art. Also, the present components preferably utilize an isophtalic polyester or a vinyl ester resin with flame retardant and ultra-violet (UV) inhibitor additives. After fabrication, all cut ends, holes and abrasions of the rig mat module preferably are sealed with a compatible resin to prevent fraying and intrusion of moisture. Should additional ultraviolet protection be required, a UV coating can be applied.

To demonstrate the utility of the present invention, a rig mat module 10 useful in a travel way or work apron assembly was produced and fabricated into an assembled surface.

EXAMPLE

Spacer Grate for Large Rig Mat Module

Figure 6:
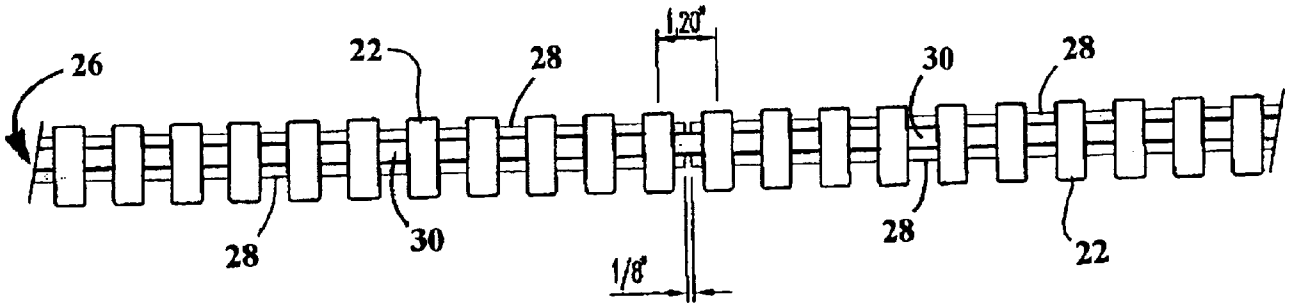
FIG. 6 is a partial schematic representation of the layout of the cross-rods of the spacer grate of a rig mat module useful in the assembly of a travel way or work apron for pedestrians and/or vehicles. Note, the top and bottom plates and the grating bars are not shown.
Figure 6:
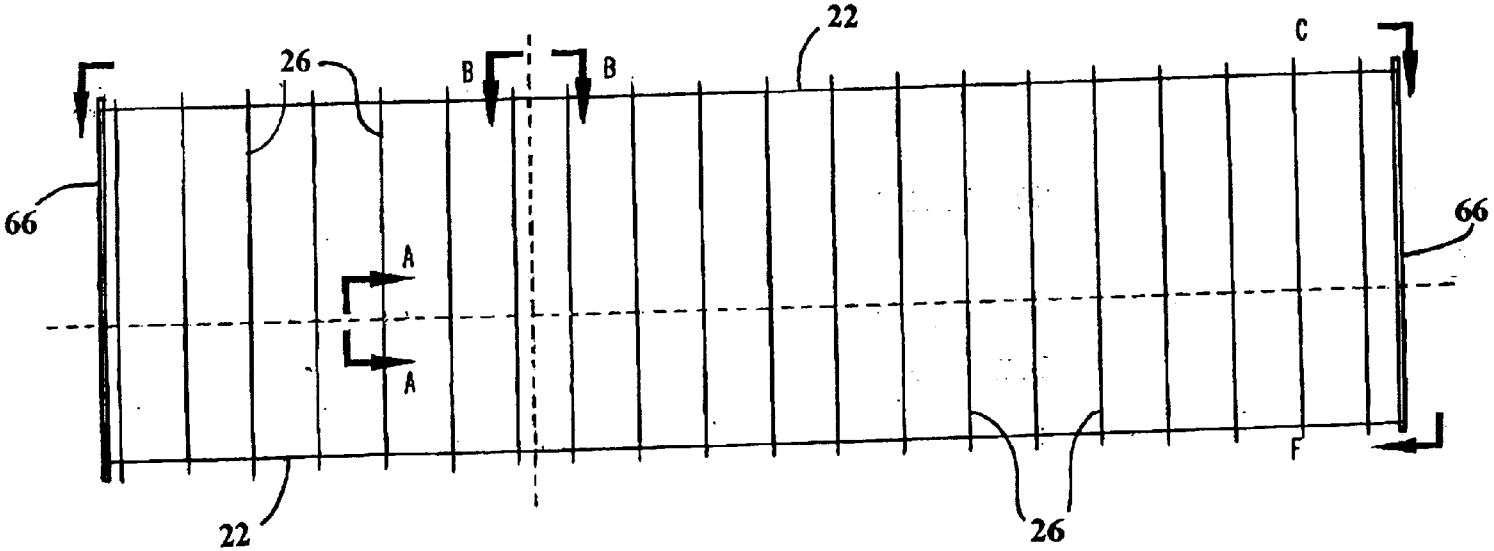

This embodiment of a rig mat module 10 was approximately 8 feet across and 30 feet long. FIG. 6 is a top view, partial schematic layout of the primary components of the rig mat module, without the top and bottom plates being shown. The cross-rods 26 were spaced at about 18 inches from the adjacent cross-rod 26. Twenty cross-rods were used. In this embodiment, the wedge-rod 30 of each cross rod 26 was a single piece. However, each of the two spacer-rods 28 comprised a two-piece length (section A, FIG. 6) which is further illustrated in FIG. 7. FIG. 7 illustrates how the two separate pieces of each spacer-rod 28 were butted together and used in combination with the wedge-rod 30 to provide the wedge-rod 26 of this embodiment.

The grating bars 22 (only 2 of a plurality shown) each had a length L of about 30 feet. Because grating bars of that length were not readily available, each grating bar 22 was comprised of two sub-lengths and butted together (section B, FIG. 6) to form an overall gating bar 22 of de desired length, which is further illustrated in FIG. 8.

The top and bottom plates 50 & 52 were constructed of 0.5 inch thick fiberglass plating. The height H of the grating bars 22, and hence the spacer grate 16, was 1.5 inches, which made the overall thickness of the rig mat module 10 about 2.5 inches. The prototype rig mat module was 8 ft.×30 ft.×2.5 in. The first successful testing of the prototype rig mat module 10 was at −34° F. and with weight in excess of 185 psi. Additional testing of the prototype rig mat module 10 to 485 psi was without failure.

While the above description contains many, specifics, these should not be constructed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A rig mat for bearing and distributing weight on a surface, the rig mat comprising:

a top plate and a bottom plate, each plate having an exposed surface, an interior surface and a perimeter edge, and the plates being disposed in parallel alignment with the interior surfaces of the plates juxtaposed to define a grating space between them;

a spacer grate disposed within the grating space, the spacer grate further comprising:

a plurality of pultruded grating bars disposed in a parallel spaced relationship to each other, each grating bar having a length of at least about 2 feet, a width of about 0.6 inches and a height of about 1.5 inches, with the width and the height defining the cross-section of the grating bar that is substantially oblong, and the spaced relationship of the grating bars is about 2-times the width of the grating bar, and the length defining the dimension of the grating bar that is in parallel with the other grating bars, and having a plurality of rod apertures passing through a surface of the grating bar perpendicular to the width of the grating bar the rod apertures having a thickness and disposed in alignment for closely passing cross-rods therethrough, a plurality of cross-rods disposed in a parallel spaced relationship to each other and in perpendicular relationship to the grating bars, the cross-rods passing through and attached to the grating bars to fix the spaced relationship of the grating bars, and each cross-rod having two spacer-rods separated by a wedge-rod, the spacer-rods having an outer engagement surface and an inner flat surface, the outer engagement surface having spaced engaging means for engaging the grate bar where the cross-rod passes through the rod-aperture, the engagement means being a plurality of notches in the outer engagement surface, for closely engaging the thickness of the rod-aperture as the cross-rod passes through the grate bar the notches being spaced apart to fix the spaced relationship of the grating bars, and the inner flat surface for slidably interfacing with the wedge-rod, and the wedge-rod having two similar opposite interface surfaces for slidably contacting the two spacer-rods and separating the spacer-rods apart and two similar opposite curvilinear surfaces disposed to closely pass through the rod-apertures, an adhesive fixing the inner flat surface of the spacer-rod to the wedge rod and the notches to the grating bar, and the spacer grate contacting and fixed to the interior surfaces of the top and bottom plates; and an edge binder disposed to engage the perimeter edges of the plates.

* * * * *